US006170674B1

(12) United States Patent
Caterinacci

(10) Patent No.: US 6,170,674 B1
(45) Date of Patent: Jan. 9, 2001

(54) PRODUCT DISPLAY SYSTEM WITH SUPPORT STRUCTURES FOR HOLDING PRODUCT IN LOCKED AND UNLOCKED CONDITIONS

(75) Inventor: John Caterinacci, Hudson, OH (US)

(73) Assignee: American Greetings Corporation, Cleveland, OH (US)

( * ) Notice: Under 35 U.S.C. 154(b), the term of this patent shall be extended for 0 days.

(21) Appl. No.: 09/418,920

(22) Filed: Oct. 15, 1999

(51) Int. Cl.[7] ..... A47F 5/00

(52) U.S. Cl. ..... 211/41.1; 211/41.15; 211/45; 211/55

(58) Field of Search ..... 211/45, 41.1, 46, 211/41.15, 181.1, 50, 55, 40, 59.2

(56) References Cited

U.S. PATENT DOCUMENTS

| | | | | |
|---|---|---|---|---|
| 2,271,346 | | 1/1942 | Rosenberger | 206/82 |
| 2,317,867 | * | 4/1943 | Taylor et al. . | |
| 2,745,556 | | 5/1956 | Lakin | 211/45 |
| 3,243,047 | * | 3/1966 | Witteborg . | |
| 3,534,863 | * | 10/1970 | Howard . | |
| 3,570,679 | * | 3/1971 | Edson . | |
| 3,965,583 | | 6/1976 | Price | 35/55 |
| 4,119,207 | * | 10/1978 | Fuller et al. | 211/45 |
| 4,179,033 | | 12/1979 | Mitchell | 211/60 R |
| 4,197,950 | | 4/1980 | Orvitz, III | 211/134 |
| 4,336,888 | * | 6/1982 | Fuller et al. | 211/45 |
| 4,475,659 | | 10/1984 | Wells et al. | 211/55 |
| 4,606,061 | | 8/1986 | Willcocks et al. | 434/74 |
| 4,925,038 | * | 5/1990 | Gajewski | 211/55 X |
| 4,930,640 | | 6/1990 | Edwards | 211/41 |
| 5,029,715 | | 7/1991 | Strada | 211/55 |
| 5,031,781 | | 7/1991 | Price et al. | 211/45 |
| 5,169,008 | | 12/1992 | Loew | 211/45 |
| 5,172,815 | * | 12/1992 | Schock et al. | 211/59.2 X |
| 5,702,011 | | 12/1997 | Carroll | 211/135 |

* cited by examiner

*Primary Examiner*—Robert W. Gibson, Jr.
(74) *Attorney, Agent, or Firm*—Arter & Hadden LLP

(57) ABSTRACT

A locking product display system has structures for supporting planar rigid objects in a display arrangement, and where at least some of the objects are locked into the display and cannot be removed. In one embodiment, upper and lower channels engage edges of the displayed article and side panels retain the article within the channels. In another embodiment end edges of a planar displayed object are supported by fixed wall support devices and capture within a channel formed by a hinge-mounted and fastener-secured member of the support device. In each embodiment, the product support structure hold one item in a locked position, and a second item in a removable position.

24 Claims, 5 Drawing Sheets

50
52
53
51
56
55
54
58

60
65
35
30

PRODUCT DISPLAY SYSTEM WITH SUPPORT STRUCTURES FOR HOLDING PRODUCT IN LOCKED AND UNLOCKED CONDITIONS

FIELD OF THE INVENTION

The present invention relates generally to product and sample display devices and more particularly to a simple and cost effective means of displaying products or material in a locked or unlocked positions. Examples of products or material that may be displayed in the device include rigid planar objects such as wood flooring samples.

BACKGROUND OF THE INVENTION

It is well known to present objects for display, as in retail stores, including products or samples of products. It is desirable to allow products or samples to be well-presented and readily removable from the display for inspection. For example, display of relatively rigid materials such as samples of floor covering material such as woods or wood laminates, these are typically marketed to customers via sample boards displayed in a rack in some fashion so as to give the customer an opportunity to look at all the varieties of flooring available. Frequently, customers wish to remove the sample boards and look at them as installed on the floor or in coordination with other home furnishings. Also often times customers wish to take home certain samples to see how they would look and match with existing home furnishings. Stores will usually allow the customers to take one or more samples to view in their homes provided they bring them back.

A common consequence of presenting items that can be readily removed from their display is that when they are removed they become misplaced or are not returned. As this relates generally to wood floor sample displays, a display will often have missing samples. This may well lead to lost sales and, at least, the necessity of the display being regularly inspected and restocked. In this regard, prior art display systems do not incorporate a simple, cost effective device for locking items to the display to prevent the removal and/or loss of items.

SUMMARY OF THE INVENTION

The present invention provides an improved display system for displaying relatively rigid and generally planar products or samples of products in a viewable array, wherein tier or row of the array can support at least one product or sample in a locked condition which cannot be removed from the display, and at least one additional product or sample which can be removed from the display for inspection.

In accordance with one general aspect of the invention, there is provided a product holding structure configured to hold a rigid product in a display orientation and wherein the product is securely held within the structure, the structure includes a first channel adapted to engage an edge of a product to be displayed, the first channel having a rear wall connected to a top wall and a front wall connected to the top wall, a second channel adapted to engage another edge of a product to be displayed, the second channel having a rear wall connected to a bottom wall and a front wall connected to the bottom wall, the first channel being generally parallel to and spaced from the second panel, the first and second channels being connected together by a wire frame, the wire frame having a first leg attached to the rear walls of the first and second channels, and a second leg attached to the rear walls of the first and second channels and spaced from the first leg, the first and second legs of the wire frame each having an angularly disposed bracket mounting section which extends from a point proximate to a point of connection of the legs to the first channel, the bracket mounting sections adapted for connection to a mounting bracket operative to mount the structure in a display orientation, the structure adapted for attachment of mounting brackets connected to the wire frame to a support panel of a product display, wherein the product display has laterally opposed walls located at opposite ends at least one of the channels whereby a product engaged by the channels of the structure cannot be removed.

In accordance with another general aspect of the invention, there is provided a product display for holding a plurality of products in a display orientation in a non-removable state, the display having a product frame having a first channel adapted for engagement with an edge of a product, and a second channel adapted for engagement with another edge of a product, the first and second frames being connected together in a generally parallel arrangement by at least two hanger elements, the hanger elements attached to backs of the channels, and bent near a point of attachment to the first channel to angularly dispose the channels with the hanger elements connected to a generally vertically oriented support panel, and side panels which traverse at least one of the first or second channels of each of the product frame, whereby product within the product frame cannot be removed from the display.

And in accordance with still another aspect of the invention, there is provided a product display system for holding and displaying product in both locked and unlocked condition, the display system having a plurality of product support devices, each product support device having a first channel adapted to support an edge of an object to be displayed, the first channel defined by a back wall, a side wall and an end wall, and a flange which is parallel to and spaced from the back wall; a second channel adjacent to the first channel, the second channel defined by the flange, the side wall and end wall, a mirror image product support device positioned laterally spaced relative to an opposing product support device, whereby lateral edges of a product are supported by the corresponding product support devices, and wherein each pair of product support devices can support a first product in a locked condition in the first channel, and support a second product in an unlocked condition in the second channel.

These and other representative aspects of the invention are herein described in particular detail with reference to the accompanying Figures.

DETAILED DESCRIPTION OF PREFERRED AND ALTERNATE EMBODIMENTS OF THE INVENTION

Figure 1:
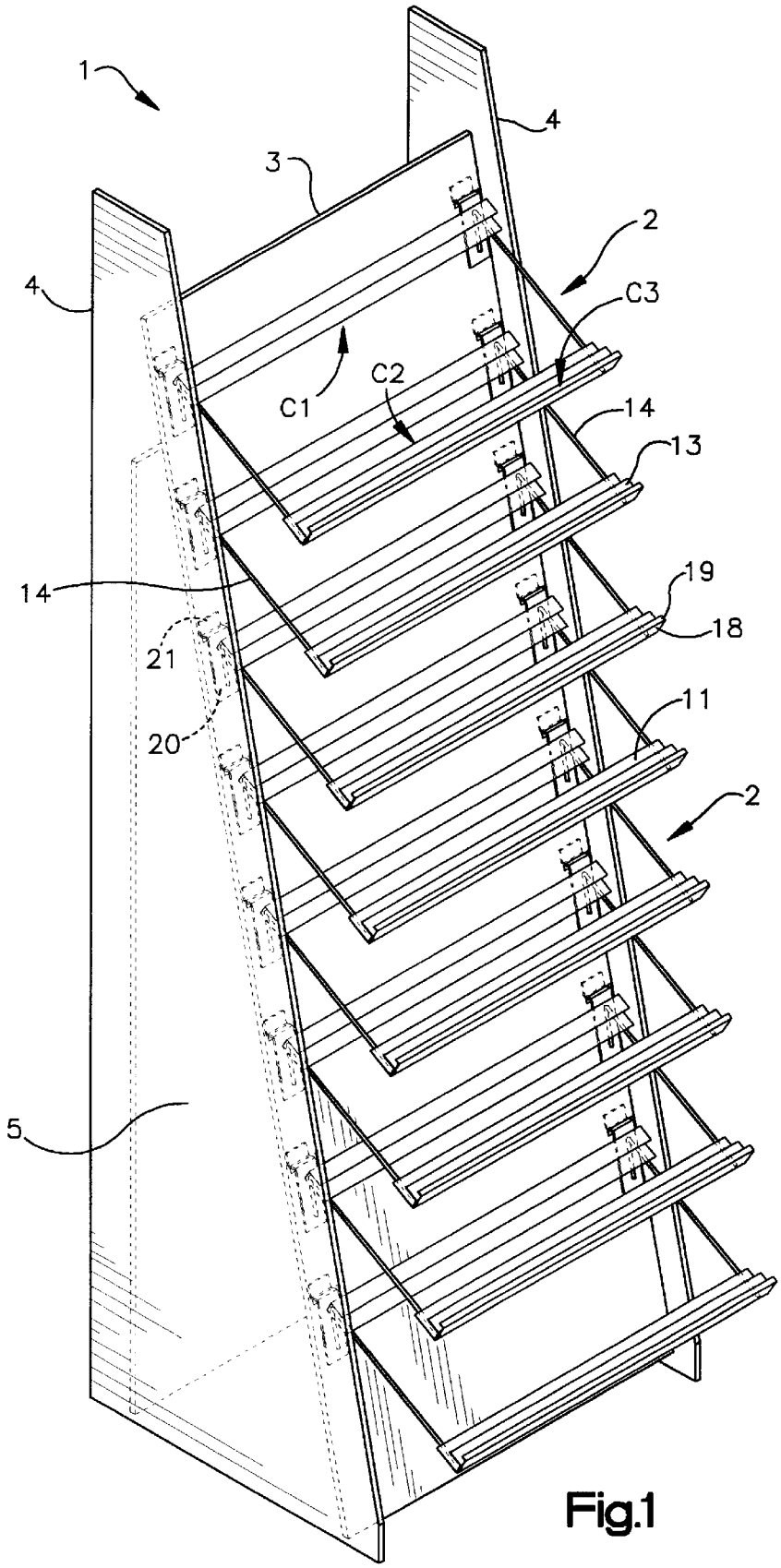
FIG. 1 is a perspective view of one embodiment of a product display system of the present invention.

Referring to FIG. 1, one embodiment of a display system, generally indicated at 1, is shown for displaying objects such as products or product samples which are generally planar and relatively rigid. However, the display system can be used in connection with any product or sample which can be engaged in the described support structures of the system. This embodiment of the display system consists of one or more product holding structures 2, one or more support panel(s) 3 to which the product holding structures 2 are attached, side walls 4 which generally flank the product holding structures 2 and can be used to lock displayed objects in place and form, along with a back panel 5, a support structure for the display system 1.

The support panel(s) 3, side walls 4 and back wall 5 can be constructed using wood products such as plywood, lumber particle board, or the like and also out of steel or plastic. The support panel(s) 3 can be attached to the side walls 4 by any suitable fasteners. Any desired number of product holding structures 2 can be attached to the support panel(s) 3 to form the display system 1. Also, the support panel(s) 3 can be set at any desired angle relative to the floor to establish a desired display orientation, as further described herein.

Figure 2:
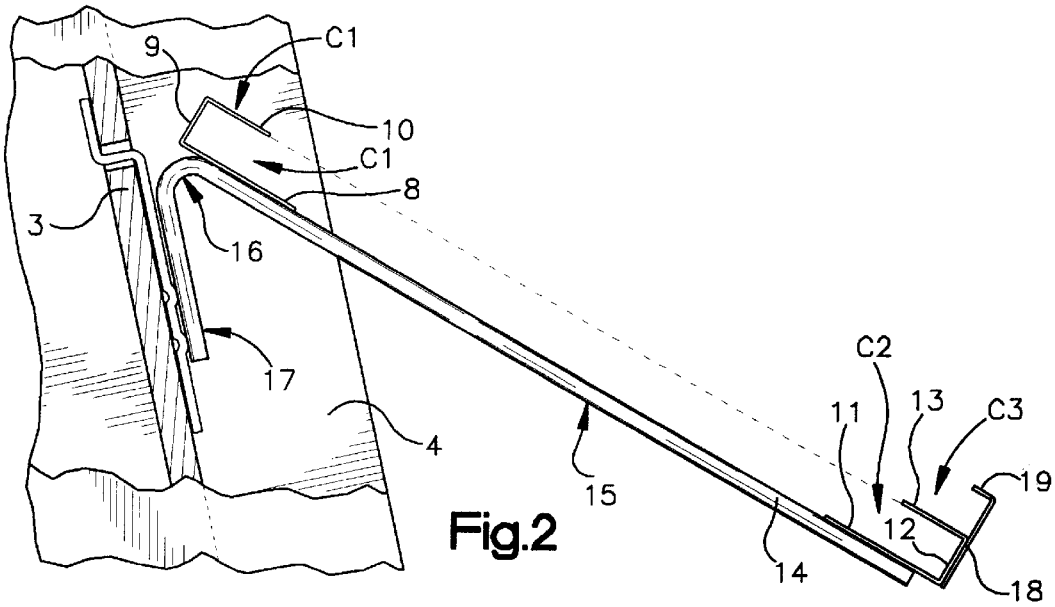
FIGS. 2, 3A and 3B are side views of one embodiment of a product support device of the present invention.

FIG. 2 shows a side view of a single product holding structure 2 mounted in the display system. The product holding structure 2 is comprised of a first channel C1 and a generally opposed and parallel spaced apart second channel C2. In this case, the second channel C2 is at a generally lower elevation than first channel C1 due to the angle of panel 3 and the manner of attachment of the support structure 2 to panel 3. The first channel C1 has a rear wall 8, a top wall 9, and a front wall 10. The second channel C2 has a rear wall 11, a bottom wall 12, and a front wall 13, connected as shown via angular bends or curves. Attached to the bottom wall 12 of the second channel C2 is an extension wall 18 which runs parallel to the bottom wall 12. A front wall 19 extends generally perpendicularly from the extension wall 18, and is generally parallel to and spaced from front wall 13, given that a width dimension of extension wall 18 is greater than a width dimension of bottom wall 12, preferably to an extent approximating or greater than a thickness of an edge of a product or sample to be inserted into the channel C3 formed by walls 13, 18 and 19.

As shown in FIG. 1, the first and second channels C1 and C2 are connected in a generally parallel and spaced apart arrangement by one or more connection members 14 which traverse the space between the channels. The connection members 14 have a long section 15 and a mounting section 17, with a bend 16 between the sections 15 and 17. The connection members may be, for example, metal rods welded or otherwise attached to the rear walls 8 and 11 of the first and second channels. The spacing between the first and second channels is such that objects with edges engaged in the channels cannot be removed, because at least one of the side walls 4 covers an end of one of the channels, as shown in FIG. 2. In this particular embodiment, the connection members 14 have a bend 15 located proximate to the first channel C1 to a mounting section 16. The mounting section 16 is as shown angled at approximately thirty degrees from the long section 15 of the connection member(s) 14, thus orienting the channels in a reclined plane. Mounting brackets 20 can be attached to the mounting section 16. The mounting brackets 20 may be J-hook type hangers with tines or flanges 21 which are engaged in openings in the rear panel 3.

Figure 3A:
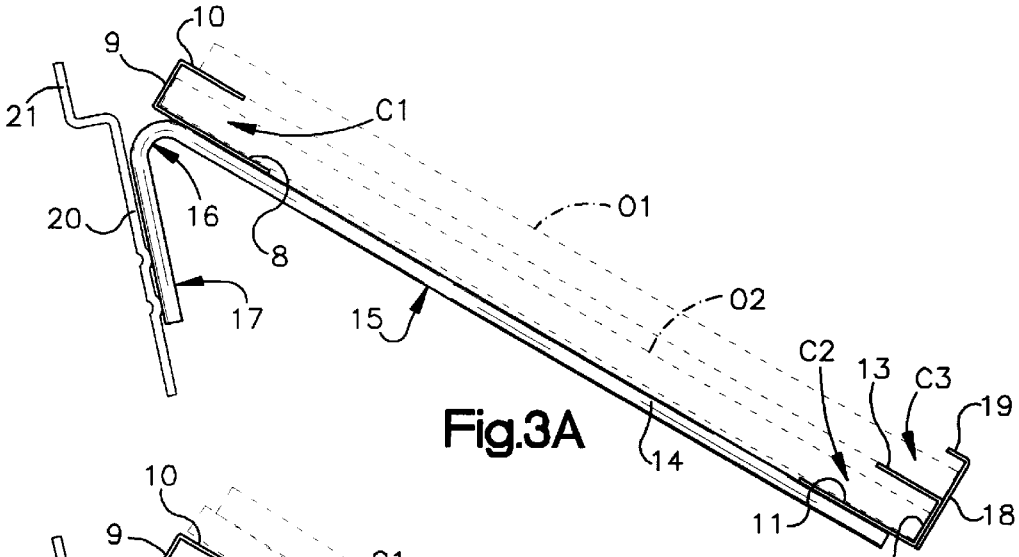
Figure 3B:
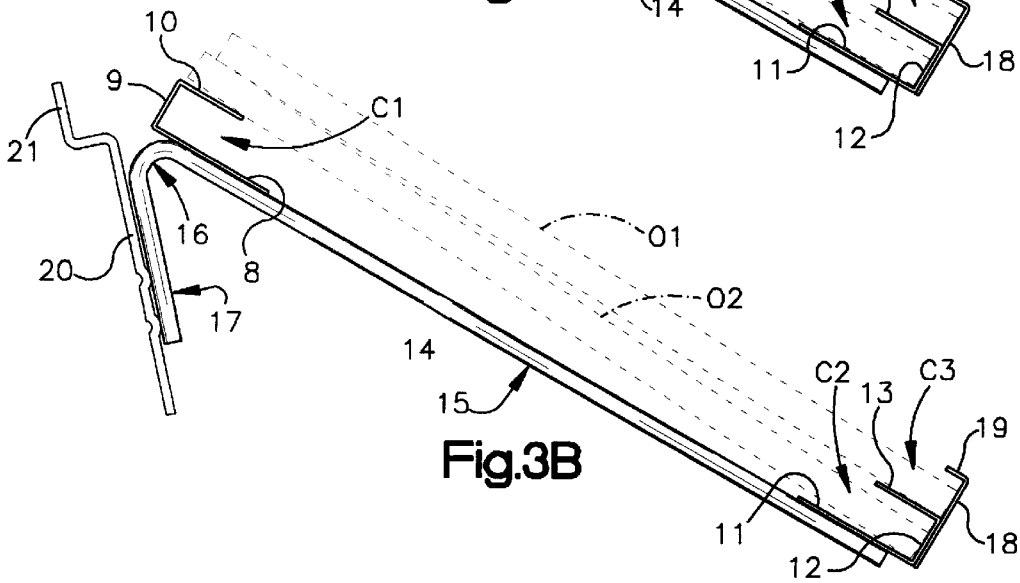

The product holding structures are manufactured in such a way as to allow objects to be concurrently displayed in locked and unlocked positions. By locking an object in place the user ensures that the object will not be lost, stolen, or misplace. By displaying objects in an unlocked position, the user can allow the objects to be removed. FIG. 3A shows a product holding structure 2 with two objects, O1 and O2, shown in phantom. Object O1 is in a locked position within channels C1 and C2. Object O2 is in an unlocked position with one lower edge in channel C2 and an upper edge resting upon the front wall 10 of channel C1. In FIG. 3B, both objects O1 and O2 are in unlocked positions, with the lower edges in channels C2 and C3 respectively, and the upper edges resting upon the front wall 10 of channel C1.

Figure 4A:
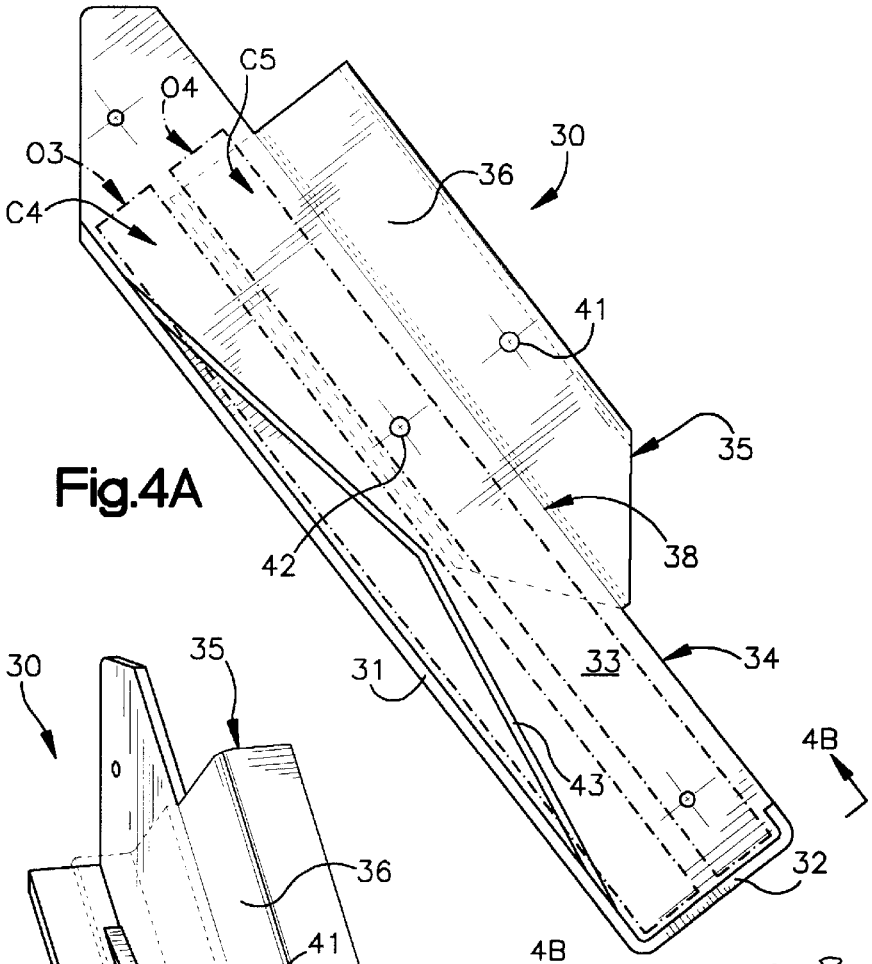
FIGS. 4A, 4B and 5 are side, end and perspective views, respectively, of an alternate embodiment of a product support device of the present invention.
Figure 4B:
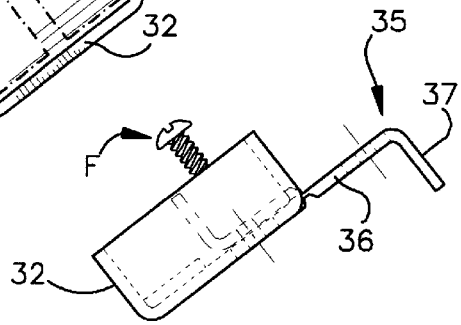
Figure 5:
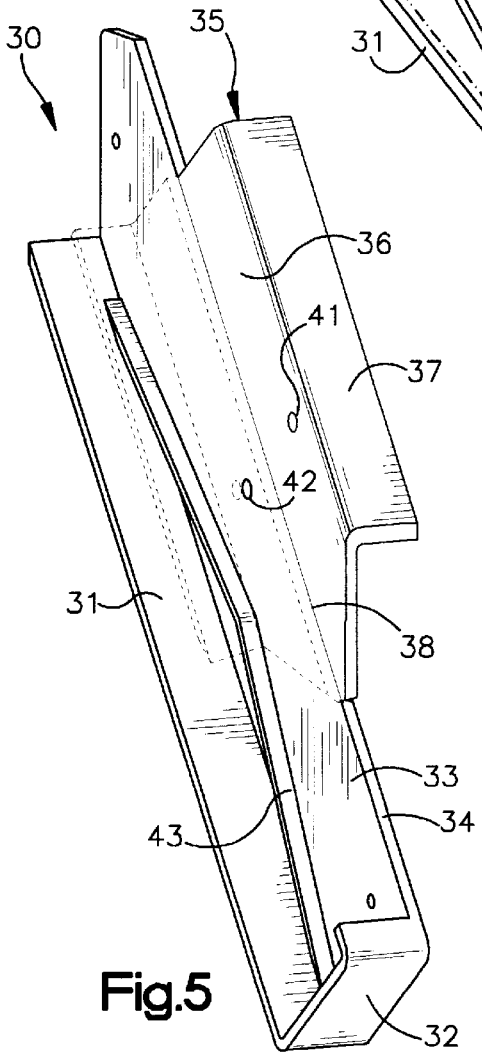
Figure 10:
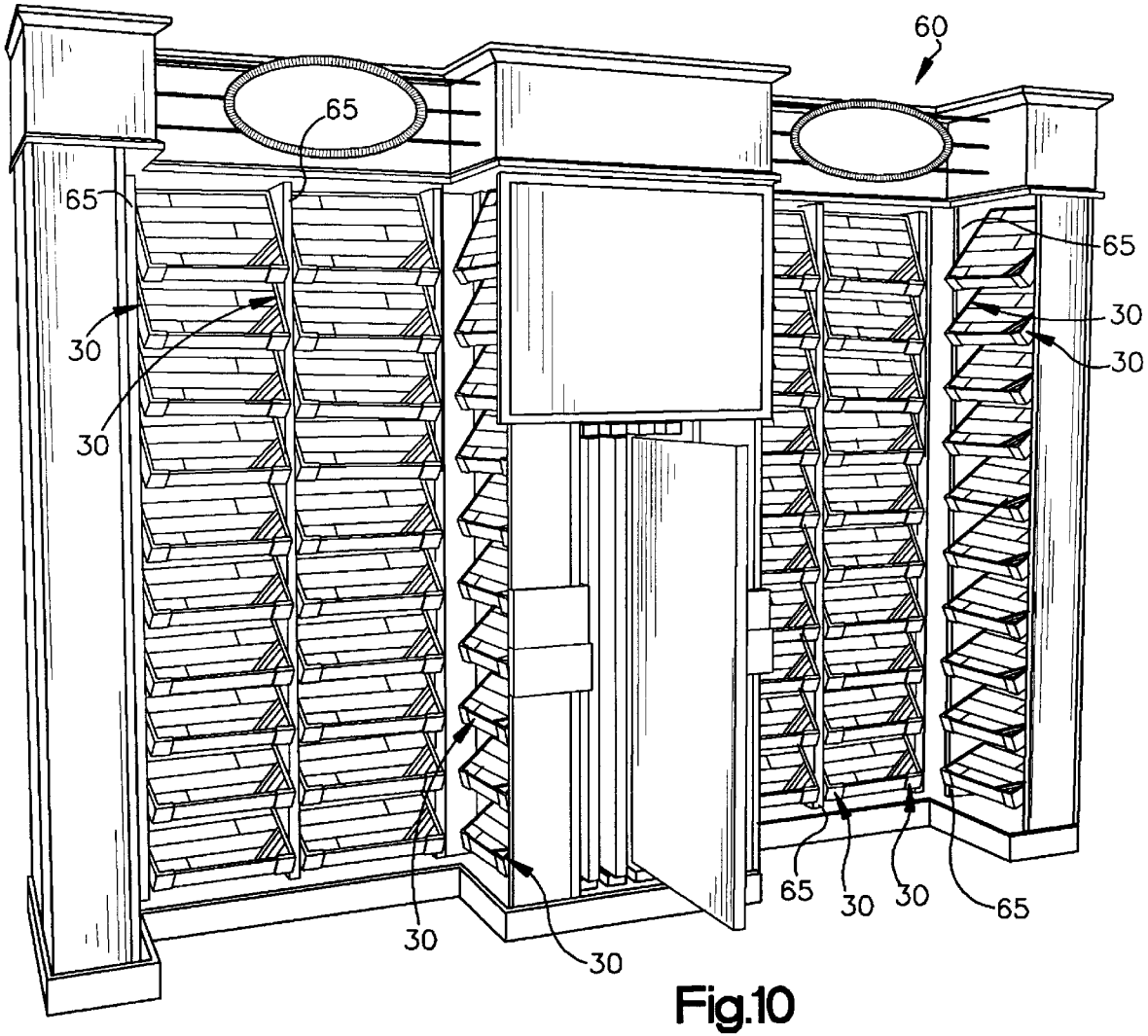
FIG. 10 is a perspective view of a product display system of the invention.

FIGS. 4 and 5 illustrate an alternate embodiment of the product holding structure aspect of the invention. A product holding structure or device 30, shown in isolation in FIGS. 4A and 5, is formed by a back wall 31, connected to a generally perpendicular a bottom wall 32, and also connected to a generally perpendicular side wall 33. Connected to a top edge 34 of the side wall 33 is a locking piece 35 which has an extension flange 36 and a locking flange 37. The locking device 35 is connected to the top edge 34 of the side wall 33 via a hinge 38 which extends along a major length of the extension flange 36. The locking piece 35 is folded about hinge into the phantom position shown in FIG. 4A, flush against an interior side of side wall 33, to form channels C4 and C5 which support side edges of objects O3 and O4. A fastener F is inserted through the aligned holes 41, 42 to retain the locking piece in the locked position. Preferably, a removable fastener, such as a plastic rivet-type screw, as manufactured by Richco, Inc. is used in the locking piece 35 and side wall 33, so that the locking piece can be re-opened to remove product or samples and to re-stock the display. Extending from an interior side of side wall 33 is a spacing rib 43, to an extent approximately equal to the thickness of the extension flange 36 of the locking piece 35. This aligns the edges of overlapping objects in the channels C4 and C5. Objects in channel C4 are locked in place, whereas objects resting in channel C5 are removable. Also, multiple planar objects can be stacked in channel C5. As shown in FIG. 10, the product holding structure(s)30 are provided in mirror image right and left pairs mounted in lateral opposition, upon generally vertical uprights, to form channels C4 and C5.

Figures 6, 7, 8, 9:
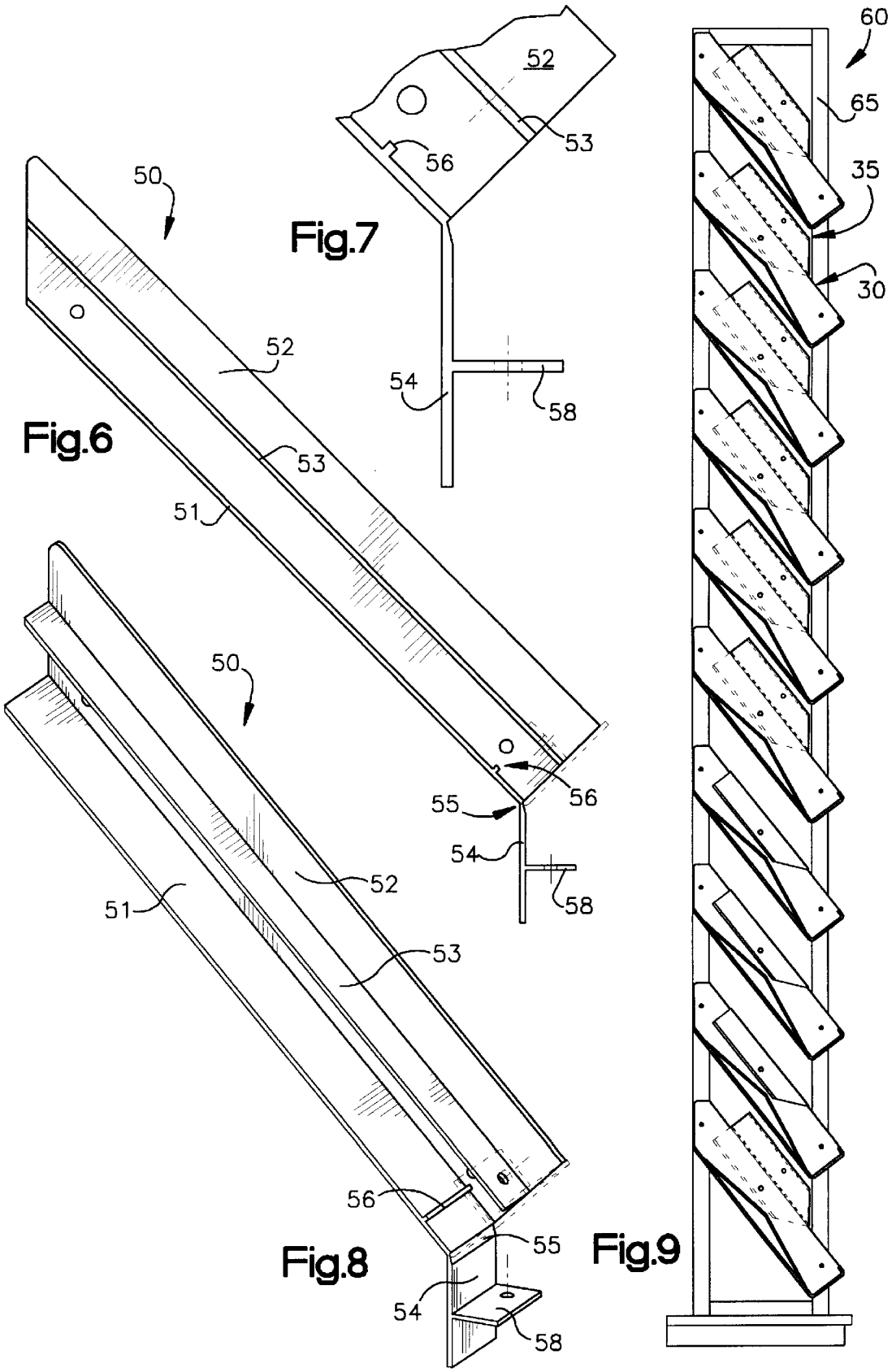
FIGS. 6, 7 and 8 are side, side end and perspective views, respectively, of an alternate embodiment of a product support device of the present invention.
FIG. 9 is a side view of a portion of one embodiment of a product display system of the invention.

FIGS. 6–8 illustrate another alternate embodiment of a product holding device 50 of the invention. The device 50 has a rear wall 51, a side wall 52 which extends generally perpendicular to and substantially the entire length of the rear wall 51, an intermediate flange 53 which is also substantially the length of the side wall 52 and which extends inwardly and generally perpendicular to the side wall, and a bottom wall 54 which is attached to the rear wall by a hinge 55. A portion of a generally planar object can be locked in place between the rear wall 51 and the intermediate flange 53 and is support by a rib 56 which spans the width of the rear wall 51. A product is locked in channel C6 formed by the walls by closure of the bottom wall 54. Extending from the bottom wall 54 is a flange 58 which is positioned closely adjacent to the rib 56 when the bottom wall 54 is in the closed position. The flange 58 is secured to the rib by a fastener or other means inserted through aligned holes.

Either of the embodiments of the product holding devices of FIGS. 4–5 or FIGS. 7–8 can be attached in laterally opposed mirror image pairs to support side edges of products and display them in an angled array in both a locked and unlocked condition in a display system 60, as shown in FIG. 10. The product support devices 30 and 50 are preferably fabricated of injection molded plastic such as polypropylene which has sufficient strength, will not cold flow and forms a living hinge capable of many cycles. FIG. 9 illustrates one mounting arrangement wherein the product support devices 30 or 50 are attached at upper and lower points to generally vertical members 65 of a display system 60. The angular orientation of the devices is variable although in this case somewhat dependent upon the spacing of the vertical members. In other installations the devices could be attached to a single vertical member with differently located fastening points. The vertical spacing of the devices is also variable. In mounting devices 30 (as shown in FIG. 9) the vertical spacing is preferably sufficient to allow the product locking flange 35 to be completely opened about hinge 38 without interference with the superior device.

FIG. 10 illustrates one example of a display system of the invention wherein a plurality of product support devices 30 or 50 are arranged in vertical tiers between multiple upright members 65. As illustrated, the vertical tiers may be side-by-side and/or angularly disposed. As described, the uppermost product or sample supported by each device is visible and removable, while the underlying objects in each tier remain in a locked position, so that even with removal of some or all of the unlocked objects the display maintains a fully stocked appearance.

It is understood that while the preferred and alternate embodiments of the present invention may be described with reference to generally planar objects or products, the present invention is also contemplated for use in connection with displaying any products, product samples or other objects which are able to be engaged by the described product support structures and devices.

What is claimed is:

1. A product holding structure configured to hold a rigid product in a display orientation and wherein the product is securely held within the structure, the structure comprising:

a first channel adapted to engage an edge of a product to be displayed, the first channel having a rear wall connected to a top wall and a front wall connected to the top wall, a second channel adapted to engage another edge of a product to be displayed, the second channel having a rear wall connected to a bottom wall and a front wall connected to the bottom wall, the first channel being generally parallel to and spaced from the second panel, the first and second channels being connected together by a wire frame, the wire frame having a first leg attached to the rear walls of the first and second channels, and a second leg attached to the rear walls of the first and second channels and spaced from the first leg, the first and second legs of the frame each having an angularly disposed bracket mounting section which extends from a point proximate to a point of connection of the legs to the first channel, the bracket mounting sections adapted for connection to a mounting bracket operative to mount the structure in a display orientation, the structure adapted for attachment of the frame to a support panel of a product display, wherein the product display has laterally opposed walls located at opposite ends at least one of the channels whereby a product engaged by the channels of the structure cannot be removed.

2. The product holding structure of claim 1 further comprising a third channel connected to the second channel, the third channel having a bottom wall and a top wall, the bottom wall being generally parallel to the bottom wall of the second channel, and the top wall being generally parallel to the top wall of the second channel.

3. The product holding structure of claim 1 in combination with J-hook mounting brackets connected to the bracket mounting sections of the first and second legs of the wire frame, the J-hook mounting brackets adapted for attachment to a support panel of a display having openings for engagement with the mounting brackets.

4. The product holding structure of claim 1 in combination with at least two products engaged by the structure, a first product having edges positioned within the first and second channels, and a second product having an edge positioned within a third channel.

5. The product holding structure of claim 1 in combination with a product display having a support panel and side walls, a product holding structure attached by mounting brackets to the support panel, and the side walls covering ends of at least one of the first or second channels.

6. The product holding structure of claim 5 wherein the support panel is positioned at a display angle relative to a horizontal surface, and front edges of the side walls are dimensioned to cover ends of at least one of the channels of a plurality of product holding structures attached to the support panel.

7. The product holding structure of claim 5 wherein the product display includes a plurality of product holding structures connected in a vertically oriented overlapping arrangement upon a support panel, wherein the second channel of a superior product holding structure overlaps the first channel of an inferior product holding structure.

8. A product display for holding a plurality of products in a display orientation in a non-removable state, the display comprising:

a product frame having a first channel adapted for engagement with an edge of a product, and a second channel adapted for engagement with another edge of a product, the first and second channels being connected together in a generally parallel arrangement by at least two hanger elements, the hanger elements attached to backs of the channels, and bent near a point of attachment to the first channel to angularly dispose the channels with the hanger elements connected to a generally vertically oriented support panel, and side panels which traverse at least one of the first or second channels of each of the product frame, whereby product within the product frame cannot be removed from the display.

9. The product display of claim 8 wherein the product frame further comprises a third channel attached to the second channel, the third channel adapted to engage one edge of a product with another edge of the product supported by the first channel or a product engaged in the first and second channels.

10. A device for lockingly engaging a portion of a product for display of the product, and for supporting a second similarly shaped product in an overlying relationship to the product lockingly engaged, the device comprising:

a generally elongate back wall perpendicularly connected to a side wall, the back wall and side wall each having a generally aligned front edge connected to a front wall, the back wall, side wall and front wall forming a product supporting structure in which a portion of a product is supportable, a locking piece connected to a top edge of the side wall, the locking piece having an extension section with a width dimension less than a width dimension of the side wall, and a product retention flange which extends generally orthogonally from an edge of the extension section not connected to the side wall, the extension section of the locking piece positionable generally parallel to the side wall, whereby the product retention flange is spaced from and generally parallel to the back wall, whereby a product engagement channel is formed between the product retention flange and the back wall, and whereby a portion of a product is further held within the product engagement channel by the front wall.

11. The device of claim 10 wherein the locking piece is attached to the side wall by a hinge between an edge of the extension flange and a top edge of the side wall.

12. The device of claim 10 further comprising a second product engagement channel formed by a surface of the product retention flange opposite the back wall, the extension flange, and the front wall.

13. The device of claim 10 further comprising a fastener between the extension flange and the side wall.

14. The device of claim 10 further comprising a lip which extends from the front wall and is generally parallel to a top edge of the side wall.

15. The device of claim 10 further comprising a rib extending from an interior side of the side wall to an extent approximately equal to a thickness of the extension flange.

16. The device of claim 10 in combination with a mirror image of the device in a laterally opposed position whereby a product support frame is formed by aligned and opposed back walls, front walls and product retention flanges of the opposed devices.

17. The device of claim 10 in combination with a product display wherein the side wall of the device is attached to a generally upright member of the product display.

18. A product display for displaying a plurality of generally planar products, each product supported by an opposed pair of product engagement devices, the opposed pairs of product engagement devices mounted in a vertical arrangement upon generally upright members of the product display, each of the product display members having a back wall, a front wall orthogonal to and extending from a front edge of the back wall, a side wall extending orthogonally from an elongate edge of the back wall, a product retention piece connected to a top edge of the side wall generally opposite to the back wall, the product retention piece having an extension section of a length less than a length of the side wall and the back wall, and a width less than a width of the side wall, a product retention flange which extends generally perpendicularly from the extension section, the extension section connected to the edge of the side wall by a hinge wherein the extension section is positionable closely adjacent and generally parallel to the side wall and whereby the product retention flange is oriented generally perpendicular to the side wall and generally parallel to and spaced from the back wall, forming a product retention channel is formed between the back wall and the product retention flange.

19. The product display of claim 18 wherein the side walls of the product engagement devices are attached to upright members of the display.

20. The product display of claim 18 wherein the extension flange of at least one of the product engagement devices is removably attached to the side wall.

21. The product display of claim 18 wherein the product engagement devices further comprise a rib which extends from an interior side of the side wall to an extent approximately equal to a thickness of the extension section of the product retention piece.

22. The product display of claim 18 wherein each of the product engagement devices further comprise a secondary product support formed by a surface of the product retention flange opposite the back wall, the extension section, and the front wall.

23. The product display of claim 18 wherein the product engagement devices are attached to upright members of a display in an angled orientation wherein the back wall is angled toward a front of the display.

24. A product display system for holding and displaying product in both locked and unlocked condition, the display system having a plurality of product support devices, each product support device having:

a first channel adapted to support an edge of an object to be displayed, the first channel defined by a back wall, a side wall and an end wall, and a flange which is parallel to and spaced from the back wall;

a second channel adjacent to the first channel, the second channel defined by the flange, the side wall and end wall, a mirror image product support device positioned laterally spaced relative to an opposing product support device, whereby lateral edges of a product are supported by the corresponding product support devices, and wherein each pair of product support devices can support a first product in a locked condition in the first channel, and support a second product in an unlocked condition in the second channel.

* * * * *